US010856598B2

(12) United States Patent
Miyata et al.

(10) Patent No.: US 10,856,598 B2
(45) Date of Patent: Dec. 8, 2020

(54) FIBER FOR ARTIFICIAL HAIR

(71) Applicant: DENKA COMPANY LIMITED, Tokyo (JP)

(72) Inventors: Koji Miyata, Kamakura (JP); Atsushi Horihata, Kamakura (JP); Kazuhito Sonoda, Kamakura (JP); Atsushi Takei, Kamakura (JP)

(73) Assignee: DENKA COMPANY LIMITED, Tokyo (JP)

( * ) Notice: Subject to any disclaimer, the term of this patent is extended or adjusted under 35 U.S.C. 154(b) by 135 days.

(21) Appl. No.: 16/085,898

(22) PCT Filed: Mar. 21, 2017

(86) PCT No.: PCT/JP2017/011202
§ 371 (c)(1),
(2) Date: Sep. 17, 2018

(87) PCT Pub. No.: WO2017/187843
PCT Pub. Date: Nov. 2, 2017

(65) Prior Publication Data

US 2019/0090565 A1 Mar. 28, 2019

(30) Foreign Application Priority Data

Apr. 28, 2016 (JP) ..... 2016-090482

(51) Int. Cl.

| | |
|---|---|
| ***A41G 3/00*** | (2006.01) |
| ***D01F 8/14*** | (2006.01) |
| ***D01F 1/07*** | (2006.01) |
| ***D01F 8/12*** | (2006.01) |

(52) U.S. Cl.
CPC ..... *A41G 3/0083* (2013.01); *D01F 1/07* (2013.01); *D01F 8/12* (2013.01); *D01F 8/14* (2013.01)

(58) Field of Classification Search
CPC ..... C08L 67/04; C08L 77/00; C08L 77/02; C08L 77/06; C08L 67/02; B32B 2555/00; B32B 2262/0276; B32B 2262/0261; A63H 3/44; D01F 1/07; D01F 1/00; D01F 6/92; D01F 6/60; D01F 6/90; D01F 8/12; D01F 8/14; D01F 6/62; D06M 2200/30; A41G 3/0083; A41G 3/00; A41G 5/004; Y10T 428/2929; Y10T 428/2931; Y10T 428/2913; D10B 2331/04; D10B 2503/08; A61F 2/10; D01D 10/00; D01D 5/34; C09K 21/08
USPC ..... 428/373, 374, 375, 395, 364, 15; 264/172.15; 524/411, 412
See application file for complete search history.

(56) References Cited

U.S. PATENT DOCUMENTS

| | | | | | |
|---|---|---|---|---|---|
| 4,370,438 | A * | 1/1983 | DeGuia | C08K 3/34 524/412 |
| 4,548,972 | A * | 10/1985 | Williams | C08K 5/34928 260/DIG. 24 |
| 2005/0014871 | A1* | 1/2005 | Chin | C08K 5/34 524/99 |
| 2009/0068463 | A1* | 3/2009 | Mochizuki | D02J 1/22 428/370 |
| 2009/0320866 | A1 | 12/2009 | Shirakashi | |
| 2011/0269878 | A1 | 11/2011 | Masuda | |
| 2013/0133676 | A1 | 5/2013 | Masuda | |

FOREIGN PATENT DOCUMENTS

| | | | | | |
|---|---|---|---|---|---|
| CN | 102864521 | A | | 1/2013 | |
| JP | 3-185103 | A | | 8/1991 | |
| JP | 4-202811 | A | | 7/1992 | |
| JP | 8-246245 | A | | 9/1996 | |
| JP | 08246245 | | * | 9/1996 | D01D 5/26 |
| JP | 2004-156149 | A | | 6/2004 | |
| JP | 2005-133250 | A | | 5/2005 | |
| JP | 2006-144211 | A | | 6/2006 | |
| JP | 2007332507 | | * | 12/2007 | |
| JP | 2011-246843 | A | | 12/2011 | |
| JP | 5063242 | B2 | | 10/2012 | |
| JP | 2013-204180 | A | | 10/2013 | |
| WO | WO-2007049561 | A1 | * | 5/2007 | D01F 1/07 |

OTHER PUBLICATIONS

International Search Report dated Jun. 6, 2017, issued in corresponding International Application No. PCT/JP2017/011202, filed Mar. 21, 2017, 2 pages.
Chinese Office Action dated Dec. 12, 2019, issued in corresponding Chinese Application No. 201780025350.5, filed Mar. 21, 2017, 13 pages.

* cited by examiner

*Primary Examiner* — Camie S Thompson
(74) *Attorney, Agent, or Firm* — Christensen O'Connor Johnson Kindness PLLC

(57) ABSTRACT

Provided is an artificial hair fiber which can prevent detachment between core and sheath, having superior texture close to human hair, and having superior curl retention. An artificial hair fiber has a core-sheath structure, including: a core; and a sheath covering the core; and: the core includes a core resin composition including polyester; the sheath includes a sheath resin composition including polyamide; the core and the sheath have a core/sheath mass ratio of 40/60 to 90/10; and when a melt viscosity of the polyester of the core is expressed as a, and a melt viscosity of the polyamide of the sheath is expressed as b, a viscosity ratio a/b is 0.5 to 2.5.

21 Claims, No Drawings

FIBER FOR ARTIFICIAL HAIR

TECHNICAL FIELD

The present invention relates to a fiber used for artificial hair capable of being attached and detached onto head, such as wig, hair-wig, hairpiece and the like (hereinafter referred to as "artificial hair fiber").

BACKGROUND

Patent Literature 1 mentions vinyl chloride as a material structuring an artificial hair fiber. This is since vinyl chloride used in artificial hair fiber is superior in workability, low cost, and the like.

However, since vinyl chloride has a glass transition temperature around 80° C., artificial hair fiber using vinyl chloride as its structuring material is inferior in heat resistance against heat from hair iron and the like. When the artificial hair fiber was curled with the hair iron at its common setting temperature range of 100° C. or higher, fusion, crimp and the like of the fiber occur, resulting in cases where the fiber is damaged or cut.

Patent Literature 2 discloses an artificial hair fiber which uses polyester as its structuring material, thereby improving heat resistance against the hair iron. However, artificial hair fiber which uses polyester as its structuring material was problematic in that its texture was hard compared with the vinyl chloride fiber. Further, Patent Literature 3 discloses an artificial hair fiber which uses polyamide as its structuring material, thereby improving the texture. However, due to the hygroscopic nature of polyamide, elastic modulus decreases, thereby causing problem in that curl retention degrades by time-lapse after the initial condition when the hair was curled.

Patent Literature 4 discloses an artificial hair fiber having a core-sheath structure structured by polyester as the core and polyamide as the sheath, thereby solving to some extent the problem to achieve both of the curl retention and texture close to human hair.

CITATION LIST

Patent Literature

[Patent Literature 1] JP 2004-156149A
[Patent Literature 2] JP 2006-144211A
[Patent Literature 3] JP 2011-246843A
[Patent Literature 4] JP H3-185103A

SUMMARY OF INVENTION

Technical Problem

However, with the technique of Patent Literature 4, there were problematic cases in that the core and the sheath were prone to detachment.

The present invention has been made in view of such circumstances, and provides an artificial hair fiber which can overcome the problem of detachment between the core and sheath, having superior texture close to human hair, and superior in curl retention.

Solution to Problem

The inventors have made a study regarding the cause of detachment between the core and the sheath. As a result, the inventors have found that when the difference between the melt viscosity of the polyester of the core and the polyamide of the sheath is large, difference is observed in the stress applied when drawing is performed, thereby resulting in difference in orientation. As a result, difference in shrinkage of the core and the sheath occur, and when heat is applied during curling with gear oven, hair iron and the like, the core and the sheath can detach. According to such findings, the inventors have found that the afore-mentioned problems can be solved by controlling the artificial hair fiber to satisfy the below constitution, thereby completing the invention.

That is, the present invention adopts the following strategy to solve the afore-mentioned problems.

(1) An artificial hair fiber having a core-sheath structure, comprising: a core; and a sheath covering the core; wherein: the core comprises a core resin composition including polyester; the sheath comprises a sheath resin composition including polyamide; the core and the sheath have a core/sheath mass ratio of 40/60 to 90/10; and when a melt viscosity of the polyester of the core is expressed as a, and a melt viscosity of the polyamide of the sheath is expressed as b, a viscosity ratio a/b is 0.5 to 2.5.

(2) The artificial hair fiber of (1) wherein the core resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

(3) The artificial hair fiber of (1) or (2), wherein the sheath resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

(4) The artificial hair fiber of (2) or (3), wherein the bromine-based flame retardant is added to the core resin composition by 3 to 30 parts by mass with respect to 100 parts by mass of the polyester.

(5) The artificial hair fiber of (3) or (4), wherein the bromine-based flame retardant is added to the sheath resin composition by 3 to 30 parts by mass with respect to 100 parts by mass of the polamide.

(6) The artificial hair fiber of any one of (1) to (5), wherein the core resin composition further comprises a compatibilizer by 0.5 to 3 parts by mass with respect to 100 parts by mass of the polyester.

(7) The artificial hair fiber of any one of (1) to (6), wherein the sheath resin composition further comprises a compatibilizer by 0.5 to 3 parts by mass with respect to 100 parts by mass of the polyamide.

(8) The artificial hair fiber of any one of (1) to (7), wherein the polyester of the core resin composition comprises polyethylene terephthalate and polybutylene terephthalate, and a mass ratio of the polyethylene terephthalate and the polybutylene terephthalate is 40/60 to 90/10.

(9) The artificial hair fiber of any one of (1) to (7), wherein the polyester of the core resin composition comprises polyethylene terephthalate and polytrimethylene terephthalate, and a mass ratio of the polyethylene terephthalate and the polytrimethylene terephthalate is 40/60 to 90/10.

(10) The artificial hair fiber of any one of (1) to (9), wherein the polyamide of the sheath resin composition comprises nylon 6,6 and nylon 6, and a mass ratio of the nylon 6,6 and the nylon 6 is 70/30 to 95/5.

Effect of the Invention

According to the present invention, an artificial hair fiber which can prevent detachment between the core and the sheath, having superior texture close to human hair, and having superior curl retention, can be provided.

EMBODIMENTS OF THE INVENTION

Hereinafter, the embodiments of the present invention will be explained.

1. Artificial Hair Fiber

The artificial hair fiber of the present invention is an artificial hair fiber having a core-sheath structure, comprising: a core; and a sheath covering the core; wherein: the core comprises a core resin composition including polyester; the sheath comprises a sheath resin composition including polyamide; the core and the sheath have a core/sheath mass ratio of 40/60 to 90/10; and when a melt viscosity of the polyester of the core is expressed as a, and a melt viscosity of the polyamide of the sheath is expressed as b, a viscosity ratio a/b is 0.5 to 2.5. The artificial hair fiber of the present invention can contain a bromine-based flame retardant and a compatibilizer arbitrarily.

(1) Mass Ratio of Core and Sheath

The core/sheath mass ratio of the core and the sheath is 40/60 to 90/10, preferably 50/50 to 85/15. When the core/sheath mass ratio is less than 40/60, polyamide of the sheath would absorb atmospheric moisture, resulting in decrease in elastic modulus. Accordingly, curl retention degrades by time-lapse after the initial condition when the hair was curled. When the core/sheath mass ratio exceeds 90/10, the polyamide layer of the sheath would be thin, and thus the superior texture close to human hair cannot be obtained.

(2) Melt Viscosity

The melt viscosity of the polyester or the polyamide was obtained under the following conditions. Polyester pellets or polyamide pellets were dehydrated and dried until the water absorption reached 100 ppm, and measurement was performed with 20 cc of sample, under the conditions of setting temperature of 285° C., piston speed of 200 mm/min, capillary length of 20 mm, and capillary diameter of 1 mm. Measurement of the melt viscosity was carried out using CAPILOGRAPH 1D manufactured by Toyo Seiki Seisakusho, Ltd.

The viscosity ratio a/b (a being a melt viscosity of the polyester of the core, and b being a melt viscosity of the polyamide of the sheath) is 0.5 to 2.5, preferably 0.8 to 2.2. When the viscosity ratio is less than 0.5, the melt viscosity of the core at the time of spinning is low, thereby resulting in thread breakage during spinning and detachment between the core and the sheath, which would be problematic. When the viscosity ratio exceeds 2.5, a problem regarding the core and the sheath would arise.

1-1. Core

The core comprises a core resin composition including polyester. There is no particular limitation regarding the polyester. Here, at least one resin selected from the group consisting of polyethylene terephthalate, polytrimethylene terephthalate and polybutylene terephthalate is preferable.

As the polyester, a resin prepared by mixing polyethylene terephthalate and polybutylene terephthalate can be used, where mass ratio is preferably 40/60 to 90/10, and more preferably 50/50 to 70/30. When the mass ratio of the polyethylene terephthalate of the core is less than 40/60, heat resistance tends to degrade, and when the mass ratio exceeds 90/10, the effect to improve texture cannot be achieved.

As the polyester, a resin prepared by mixing polyethylene terephthalate and polytrimethylene terephthalate can also be used, where mass ratio is preferably 40/60 to 90/10, and more preferably 50/50 to 70/30. When the mass ratio of the polyethylene terephthalate of the core is less than 40/60, heat resistance tends to degrade, and when the mass ratio exceeds 90/10, the effect to improve texture cannot be achieved.

It is preferable that only polyester is included as the resin component in the core resin composition, however, other resin may be contained. Mass ratio of polyester/total resin component in the core resin composition is preferably 0.8 or higher, more preferably 0.9 or higher, and further preferably 1.

1-2. Sheath

The sheath comprises a sheath resin composition including polyamide. There is no particular limitation regarding the polyamide. Here, at least one resin selected from the group consisting of nylon 6, nylon 6,6, nylon 4,6, nylon 12, nylon 6,10, nylon 6,12, polyamide 6T, polyamide 9T, polyamide 10T, and modified polyamides obtained by co-polymerizing monomers for modification with polyamide 6T, polyamide 9T and polyamide 10T, such as modified polyamide 6T, modified polyamide 9T, and modified polyamide 10T is preferable. Further, nylon 6,6 and nylon 6 are particularly preferable.

When a resin obtained by mixing nylon 6,6 and nylon 6 is adopted as the polyamide of the sheath used in the present invention, a superior texture close to human hair can achieved.

The mass ratio of nylon 6,6 and nylon 6 in the sheath is preferably 70/30 to 95/5, and more preferably 80/20 to 90/10. When the mass ratio of nylon 6,6 of the sheath is less than 70/30, heat resistance tends to degrade, and when the mass ratio exceeds 95/5, the effect to improve texture cannot be achieved.

It is preferable that only polyamide is included as the resin component in the sheath resin composition, however, other resin may be contained. Mass ratio of polyamide/total resin component in the sheath resin composition is preferably 0.8 or higher, more preferably 0.9 or higher, and further preferably 1.

1-3. Flame Retardant

At least one (preferably both) of the core resin composition and the sheath resin composition can contain a flame retardant. By adding the flame retardant to at least one of the core resin composition and the sheath resin composition, the flame retardant would be dispersed in the interface between the polyester of the core and the polyamide of the sheath, thereby improving detachment resistance and providing flame retardancy at the same time. As the flame retardant, a bromine-based flame retardant, a phosphorus-based flame retardant, a nitrogen-based flame retardant, a hydrated metal compound, and the like can be mentioned. Here, the combination of the bromine-based flame retardant and a flame retardant aid shows flame retardancy most effectively, and is thus preferable.

As the bromine-based flame retardant, for example, brominated polystyrene-based flame retardant, ethylene bis tetrabromophthalimide-based flame retardant, bis (pentabromophenyl) ethane-based flame retardant, brominated epoxy-based flame retardant, brominated phenoxy-based flame retardant, brominated benzyl acrylate-based flame retardant, brominated phenol-based flame retardant, polydibromophenylene oxide-based flame retardant and the like can be mentioned. Among these, in terms of the balance between flame retardancy, workability, transparency of original yarn and the like, brominated epoxy-based resin or brominated phenol-based resin are preferable.

The amount of the bromine-based flame retardant added is preferably 3 to 30 parts by mass, more preferably 5 to 25 parts by mass based on 100 parts by mass of the polyester of the core or the polyamide of the sheath. When the amount added is less than 3 parts by mass, flame retardancy cannot be obtained, and when the amount added exceeds 30 parts by mass, dispersion into the resin would be insufficient, resulting in degraded spinning characteristics.

In order to improve flame retardancy, it is possible to add a flame retardant aid which is used in combination with the aforementioned bromine-based flame retardant. Examples of the flame retardant aid include antimony trioxide, antimony tetraoxide, antimony pentoxide, sodium antimonate, zinc borate, and zinc stannate. Among these, antimony trioxide is preferred from the viewpoint of the balance between drip resistance and transparency of the original yarn.

The amount of the flame retardant aid added is preferably 0.1 to 10 parts by mass, more preferably 0.5 to 5 parts by mass based on 100 parts by mass of the polyester of the core or the polyamide of the sheath. When the amount added is less than 0.1 parts by mass, effect of the flame retardant aid is low, and when the amount added exceeds 10 parts by mass, dispersion into the resin would be insufficient, resulting in thread breakage and unstable spinning.

It is preferable that the flame retardant aid has an average particle diameter in the range of 0.5 to 10 μm, more preferably in the range of 1 to 8 μm, in terms of transparency of the original yarn and workability. When the average particle diameter is smaller than 0.5 μm, aggregation would cause insufficient dispersion, and when the average particle diameter exceeds 10 μm, cloudiness of the fiber would be problematic.

1-4. Compatibilizer

At least one (preferably both) of the core resin composition and the sheath resin composition can contain a compatibilizer. By adding the compatibilizer to at least one of the core resin composition and the sheath resin composition, resistance to detachment at the interface between the core and the sheath can be improved, and thus it becomes possible to perform iron curling at a higher temperature.

As the compatibilizer, for example, maleic anhydride modified polymer, maleic anhydride modified ethylene butyl acrylate, polycarbodiimide, carbodiimide modified isocyanate, styrene-acrylonitrile-glycidyl methacrylate random copolymer, epoxy-styrene-acrylonitrile copolymerized micro gel, styrene-acrylonitrile-maleic anhydride copolymer, LLDPE-maleic anhydride graft polymer, polyolefin-maleic anhydride graft polymer, polyolefin-glycidyl methacrylate graft polymer, modified polyolefin, copolymer of styrene and maleic acid half ester, styrene/maleic anhydride copolymer, and a copolymer of styrene and maleic acid half ester can be mentioned. Among these, maleic anhydride modified polymer is preferable since reaction occur between the terminal carboxyl group of the polyester of the core and the terminal amino group of the polyamide of the sheath via the compatibilizer, thereby suppressing detachment between the core and the sheath.

The amount of the compatibilizer added is preferably 0.5 to 3 parts by mass based on 100 parts by mass of the polyester of the core or the polyamide of the sheath. When the amount added is less than 0.5 parts by mass, effect of improving resistance to detachment is low, and when the amount added exceeds 3 parts by mass, the viscosity of the polyester of the core or the polyamide of the sheath decreases or increases dramatically, which is unfavorable in terms of workability.

Regarding the polyester of the core in the present invention, by adopting a resin prepared by mixing polyethylene terephthalate and polybutylene terephthalate or polypropylene terephthalate, the texture would become superior, close to human hair.

1-5. Other Components

At least one (preferably both) of the core resin composition and the sheath resin composition can contain, if necessary, an additive such as a heat resistant agent, a light stabilizer, a fluorescent agent, an antioxidant, an antistatic agent, a pigment, a dye, a plasticizer, and a lubricant. By allowing to contain colorants such as the pigment or the dye, fiber colored beforehand (so-called a dyed fiber) can be obtained.

2. Manufacturing Method of Artificial Hair Fiber

Hereinafter, an example of the manufacturing method of the artificial hair fiber will be explained. However, the present invention shall not be limited to such.

As the manufacturing method of the artificial hair fiber having a core-sheath structure of the present invention, there is no particular limitation so long as it is a manufacturing method of the artificial hair fiber having a core-sheath structure. Here, for example, the artificial hair fiber having a core-sheath structure can be obtained using a complex melt spinning extruder structured with two extruders for core formation and sheath formation, respectively.

(1) Melt Spinning Step

To a thermoplastic resin such as the polyester of the core and the polyamide of the sheath, the afore-mentioned additives such as flame retardant, compatibilizer, particles and the like are dry-blended beforehand by a predetermined ratio. Subsequently, melting and kneading are performed using a kneader, thereby obtaining pellets of the core resin composition and pellets of the sheath resin composition. As the device for performing melting and kneading, various general kneading machines can be used. As the melting and kneading machine, a single screw extruder, a twin-screw extruder, a roll, a Banbury mixer, a kneader and the like can be mentioned for example. Among these, the twin-screw extruder is preferable in terms of simplicity to adjust the kneading degree and operation.

The pellets of the core resin composition and pellets of the sheath resin composition obtained by mixing and kneading are dried separately. In order to dry the polymer, known devices such as a vacuum dryer, a hopper dryer and the like can be appropriately selected and used. Here, in the case of the pellets of the core resin composition, it is preferable that the moisture content of the pellets is 100 ppm or lower (100 mg/kg or lower). In the case of the pellets of the sheath resin composition, it is preferable that the moisture content of the pellets is 1000 ppm or lower (1000 mg/kg or lower). When the moisture content of the pellets of the core resin composition and the pellets of the sheath resin composition are high, there is a concern that the viscosity may decrease during spinning or that the molecular weight may decrease due to hydrolysis. Accordingly, by using pellets having their moisture content controlled to a certain amount or lower, spinning operation capability can be improved.

The dried pellets of the core resin composition are charged into an extruder for core formation, and the dried pellets of the sheath resin composition are charged into an extruder for sheath formation. Using the extruder, each of the pellets of the core resin composition and the pellets of the sheath resin composition are melt and kneaded, and then are introduced into the spinning head so that the core resin composition is formed as the core and the sheath resin composition is formed as the sheath. Then, melting and spinning is performed from the core-sheath complex nozzle. Melting and spinning is performed, for example, by setting the temperature of the melting and spinning device such as the extruder, a gear pump, and the mouth piece at 270 to 310° C., performing melting and spinning, and then air-cooling using a cold-wind blowing cylinder. Accordingly, the fiber is cooled and solidified to a temperature below the glass transition temperature. After cooling and solidifying, spinning oil is applied using an oil applicator. Here, the temperature and the length of the cold-wind tower, temperature and blowing amount of the cold-wind tower, cooling time, and hauling speed can be arbitrarily adjusted by the jetting amount and the number of holes in the mouthpiece. As another cooling method, the spun fiber can be cooled with a water tank filled with water for cooling, thereby controlling the size of fiber. Subsequently, the fiber is wound using a winder, thereby obtaining a core-sheath undrawn fiber. There is no particular limitation regarding the winding speed, and winding speed in the range of 50 to 300 m/min is preferable.

(2) Drawing Step

The undrawn fiber obtained is subjected to drawing treatment using a drawing machine, in order to improve the tensile strength of the fiber. There is no particular limitation regarding the drawing conditions, and the drawing magnitude can be set to 2.5 to 5.0 times, drawing speed can be set to 10 to 500 m/min, and the temperature can be set to 25 to 150° C., thereby obtaining the desired core-sheath structure artificial hair fiber. There is no particular limitation regarding the method for drawing treatment, and a two-step method in which the undrawn fiber is first wound onto a bobbin and then drawn in a step different from the melting and spinning step, or a direct spinning and drawing method in which the undrawn fiber is not wound onto a bobbin and is continuously drawn after the melting and spinning step, can be adopted. Here, the drawing treatment can be a single-stage drawing method in which the fiber is drawn to the desired drawing magnitude after one drawing process, or can be a multi-stage drawing method in which the fiber is drawn to the desired drawing magnitude after two or more drawing processes. Heater used in the hot drawing treatment can be a heating roller, a heat plate, a steam jet device, and a hot water tank. These heaters can be used in combination.

(3) Heat Treatment Step

In the fiber subjected to the winding treatment, a residual stress is generated during winding. Therefore, in order to secure the quality of the artificial hair as the final product, it is preferable to remove the residual stress by heat treatment. In some cases, at the same time as this heat treatment, the wound fiber can be subjected to a heat treatment by 1 to 30%.

As the temperature conditions of the heat treatment, it is preferable to perform the heat treatment under the atmospheric temperature conditions of 150 to 250° C. The atmospheric gas used in the heat treatment is not particularly limited. Here, other than the atmospheric air, inert gas can also be used. As the inert gas, nitrogen, argon and the like can be used, however, it is preferable to use atmospheric gas in terms of cost.

In the heat treatment step, it is preferable to subject the undrawn fiber to hot drawing and heat treatment, thereby achieving the size of 10 to 100 dtex. The lower limit of the size of the afore-mentioned artificial hair fiber having core-sheath structure is more preferably 20 dtex or more, and further preferably 35 dtex or more. The upper limit of the size of the afore-mentioned artificial hair fiber having core-sheath structure is more preferably 90 dtex or less, and further preferably 80 dtex or less.

In the manufacturing method of the artificial hair fiber according to the present technique as described above, conventionally known technique related to melting and spinning can be used if necessary. Such technique, for example, technique related to various cross-sectional shape of nozzles, technique related to cooling, technique related to drawing treatment, and technique related to heat treatment can be arbitrarily combined.

To the artificial hair fiber thus manufactured, a treating agent including oil such as silicone can be applied to improve its texture and the like. Application of the treating agent can be carried out at any timing among before processing the artificial hair fiber into a hair product, during processing, or after processing. Here, in terms of workability and uniformity of application and the like, application during processing the artificial hair fiber into a hair product is suitable.

3. Hair Accessories

The artificial hair fiber can be used alone as a hair product (head accessory), or can be used in combination with human hair or other artificial hair. Hair product includes wig, hair piece, blade, extension hair, hair of a doll and the like, and the use of the artificial hair fiber is not particularly limited to these. In addition, other than the hair product, the artificial hair fiber can be used for false beard, false eyelashes, and false eyebrows.

EXAMPLES

Next, Examples of the artificial hair fiber of the present invention will be described in detail with comparison with Comparative Examples and with reference to the Tables. Although the embodiments of the present invention will be described more specifically based on the Examples, the present invention shall not be limited to these.

Example 1

1. Dehydration of Materials

A hopper dryer (available from KAWATA MFG CO., Ltd., CHALLENGER III) was used to dehumidify and dry the pellets at 120° C. for 12 hours from the condition where the temperature became constant, thereby allowing the pellets of the core resin composition shown in Table 1 to have a moisture content of 100 ppm or lower (100 mg/kg or lower). Further, with the pellets of the sheath resin composition shown in Table 1, similar procedure was carried out at 80° C. for 12 hours, thereby allowing the pellets of the sheath resin composition shown in Table 1 to have a moisture content of 1000 ppm or lower (1000 mg/kg or lower).

2. Spinning Step As the extruder, two melt spinning extruders having Φ20 mm (available from GM ENGINEERING Co., Ltd., full-flight screw (compression ratio of 2.3)) were combined and used. As the die, a core-sheath complex nozzle (number of holes: 36, hole diameter: 1 mm) was used. Regarding the settings of the extruder for forming the core and the sheath, the temperature of the cylinder of the extruder for forming the core was set to 295° C., and the cylinder of the extruder for forming the sheath was set to 315° C. Here, adjustment was made so that the nozzle temperature would be 300° C., and the rotation number of the screw of the two extruders and the rotation number of the gear pump were set so that the jetting amount after reaching an equilibrium state would be 30 g/min, and the core/sheath forming ratio would be 50/50. The strand was melt and spun in a vertical direction from the die, and the undrawn fiber was wound at a constant speed using a haul-off machine arranged at a point of 2 m directly below the nozzle. Here, the temperature and the blowing amount of the cold-wind tower, and the hauling speed of the hauling machine were adjusted so that the size of the undrawn fiber would be approximately 210 d.

3. Drawing Step

Drawing was carried out by a single-stage drawing method of hot-water drawing, and the temperature of the hot-water bath was set to 90° C., and the drawing was performed by a magnitude of 3.5 times.

4. Heat Treatment Step

The drawn fiber having a core-sheath structure was subjected to 5 minutes of heat treatment at 190° C., using a hot-wind annealing, thereby obtaining an artificial hair fiber having a size of 60 d.

Examples 2 to 19, Comparative Examples 1 to 4

Examples 2 to 19 and Comparative Examples 1 to 4 were prepared in a similar manner in accordance with the description provided in Tables 1 to 3.

Regarding workability and the artificial hair fiber thus obtained, detachment resistance, texture, and curling characteristics were evaluated using the methods and standards provided hereinafter.

TABLE 1

| | | | Example | | | | | | Comparative Example | | | |
|---|---|---|---|---|---|---|---|---|---|---|---|---|
| | | | 1 | 2 | 3 | 4 | 5 | 6 | 1 | 2 | 3 | 4 |
| core/sheath mass ratio | | | 50/50 | 70/30 | 85/15 | 70/30 | 70/30 | 70/30 | 30/70 | 95/5 | 70/30 | 70/30 |
| melt viscosity of polyester of core a | | | 145 | 145 | 145 | 145 | 204 | 145 | 145 | 145 | 450 | 65 |
| melt viscosity of polyamide of sheath b | | | 140 | 140 | 140 | 240 | 249 | 66 | 140 | 140 | 140 | 249 |
| viscosity ratio a/b | | | 1.04 | 1.04 | 1.04 | 0.58 | 0.82 | 2.20 | 1.04 | 1.04 | 3.21 | 0.26 |
| formulation | core resin composition | PET1 | — | — | — | — | — | — | — | — | — | 100 |
| | | PET2 | 100 | 100 | 100 | 100 | — | 100 | 100 | 100 | — | — |
| | | PET3 | — | — | — | — | 100 | — | — | — | — | — |
| | | PET4 | — | — | — | — | — | — | — | — | 100 | — |
| | | PET5 | — | — | — | — | — | — | — | — | — | — |
| | | PET6 | — | — | — | — | — | — | — | — | — | — |
| | | flame retardant 1 | — | — | — | — | — | — | — | — | — | — |
| | | compatibilizer | — | — | — | — | — | — | — | — | — | — |
| | sheath resin composition | PA1 | — | — | — | — | — | 100 | — | — | — | — |
| | | PA2 | 100 | 100 | 100 | — | — | — | 100 | 100 | 100 | — |
| | | PA3 | — | — | — | 100 | 100 | — | — | — | — | 100 |
| | | PA4 | — | — | — | — | — | — | — | — | — | — |
| | | flame retardant 2 | — | — | — | — | — | — | — | — | — | — |
| | | compatibilizer | — | — | — | — | — | — | — | — | — | — |
| evaluation | detachment resistance | | B | B | B | B | B | B | B | B | C | C |
| | texture | | B | B | B | B | B | B | B | C | B | B |
| | curling characteristics | | B | B | A | B | B | B | C | A | B | B |

TABLE 2

| | | | Example | | | | | | |
|---|---|---|---|---|---|---|---|---|---|
| | | | 7 | 8 | 9 | 10 | 11 | 12 | 13 |
| core/sheath mass ratio | | | 70/30 | 70/30 | 70/36 | 70/30 | 70/30 | 70/30 | 70/30 |
| melt viscosity of polyester of core a | | | 147 | 151 | 151 | 145 | 145 | 145 | 150 |
| melt viscosity of polyamide of sheath b | | | 148 | 142 | 148 | 140 | 140 | 140 | 148 |
| viscosity ratio a/b | | | 0.99 | 1.06 | 1.02 | 1.03 | 1.04 | 1.04 | 1.02 |
| formulation | core resin composition | PET1 | — | — | — | — | — | — | — |
| | | PET2 | 100 | 100 | 100 | 100 | 100 | 100 | 100 |
| | | PET3 | — | — | — | — | — | — | — |
| | | PET4 | — | — | — | — | — | — | — |
| | | PET5 | — | — | — | — | — | — | — |
| | | PET6 | — | — | — | — | — | — | — |
| | | flame retardant 1 | 5 | 20 | 20 | — | — | — | 20 |
| | | compatibilizer | — | — | — | 1.5 | — | 1.5 | 1.5 |
| | sheath resin composition | PA1 | — | — | — | — | — | — | — |
| | | PA2 | 100 | 100 | 100 | 100 | 100 | 100 | 100 |
| | | PA3 | — | — | — | — | — | — | — |
| | | PA4 | — | — | — | — | — | — | — |
| | | flame retardant 2 | 20 | 5 | 20 | — | — | — | 20 |
| | | compatibilizer | — | — | — | — | 1.5 | 1.5 | 1.5 |

TABLE 2-continued

| | | Example | | | | | | |
|---|---|---|---|---|---|---|---|---|
| | | 7 | 8 | 9 | 10 | 11 | 12 | 13 |
| evaluation | detachment resistance | A | A | A | A | A | A | A |
| | texture | B | B | B | B | B | B | B |
| | curling characteristics | B | B | B | B | B | B | B |

TABLE 3

| | | | Example | | | | | |
|---|---|---|---|---|---|---|---|---|
| | | | 14 | 15 | 16 | 17 | 18 | 19 |
| core/sheath mass ratio | | | 70/30 | 70/30 | 70/30 | 70/30 | 70/30 | 70/30 |
| melt viscosity of polyester of core a | | | 132 | 137 | 139 | 141 | 145 | 145 |
| melt viscosity of polyamide of sheath b | | | 140 | 140 | 140 | 140 | 123 | 132 |
| viscosity ratio a/b | | | 0.94 | 0.98 | 0.99 | 1.01 | 1.18 | 1.10 |
| formulation | core resin composition | PET1 | — | — | — | — | — | — |
| | | PET2 | 50 | 70 | 50 | 70 | 100 | 100 |
| | | PET3 | — | — | — | — | — | — |
| | | PET4 | — | — | — | — | — | — |
| | | PET5 | 50 | 30 | — | — | — | — |
| | | PET6 | — | — | 50 | 30 | — | — |
| | | flame retardant 1 | — | — | — | — | — | — |
| | | compatibilizer | — | — | — | — | — | — |
| | sheath resin composition | PA1 | — | — | — | — | — | — |
| | | PA2 | 100 | 100 | 100 | 100 | 80 | 90 |
| | | PA3 | — | — | — | — | — | — |
| | | PA4 | — | — | — | — | 20 | 10 |
| | | flame retardant 2 | — | — | — | — | — | — |
| | | compatibilizer | — | — | — | — | — | — |
| evaluation | detachment resistance | | B | B | B | B | B | B |
| | texture | | A | A | A | A | A | A |
| | curling characteristics | | B | B | B | B | B | B |

As the materials mentioned in Tables 1 to 3, the followings were used.

<Polyester>

PET 1: polyethylene terephthalate (manufactured by Denka Company Limited, melt viscosity of 65 Pa·s)

PET 2: polyethylene terephthalate (manufactured by Mitsui Chemicals, Inc., J125S, melt viscosity of 145 Pa·s)

PET 3: polyethylene terephthalate (manufactured by Denka Company Limited, melt viscosity of 204 Pa·s)

PET 4: polyethylene terephthalate (manufactured by Mitsui Chemicals, Inc., J055, melt viscosity of 450 Pa·s)

PET 5: polyebutylene terephthalate (manufactured by Du Pont, S600F20, melt viscosity of 118 Pa·s)

PET 6: polytrimethylene terephthalate (manufactured by Du Pont, Sorona EP 3301NC010, melt viscosity of 132 Pa·s)

<Polyamide>

PA 1: polyamide 66 (manufactured by Toray Industries, Inc., AMILAN CM3001-N, melt viscosity of 66 Pa·s)

PA 2: polyamide 66 (manufactured by Du Pont, Zytel 101, 140 Pa·s)

PA 3: polyamide 66 (manufactured by Du Pont, Zytel 42A, 249 Pa·s)

PA 4: polyamide 6 (manufactured by Denka Company Limited, 56 Pa·s)

<Flame Retardant> flame retardant 1: brominated benzyl acrylate-based flame retardant (manufactured by ICL JAPAN, FR-1025)

flame retardant 2: brominated epoxy-based flame retardant (manufactured by Sakamoto Yakuhin Kogyo Co., Ltd., SR-T20000)

<Compatibilizer> maleic anhydride modified polymer (manufactured by Du Pont, Fusabond, A560)

The method and standard for evaluating each of the evaluation item are as follows.

<Detachment Resistance>

Detachment resistance was evaluated in the following manner. A fiber bundle sample with a length of 200 mm and mass of 1.0 g was prepared with the artificial hair fiber. Subsequently, the tip of the fiber bundle sample was heated for 10 seconds using a hair iron, and the protrusion of the polyester of the core due to the difference in the thermal shrinkage between the polyester of the core and the polyamide of the sheath was visually observed for evaluation. Evaluation was performed in the following manner by judging the temperature of the hair iron at which such thermal detachment was caused.

A: No thermal detachment was observed with the hair iron temperature of 220° C.

B: No thermal detachment was observed with the hair iron temperature of 200° C., but thermal detachment was observed at 220° C.

C: Thermal detachment was observed with the hair iron temperature of 200° C.

<Texture>

For the evaluation of texture, a fiber bundle sample with a length of 250 mm and mass of 20 g was prepared with the artificial hair fiber. Texture was evaluated by 10 artificial hair fiber treating technical specialists (5 or more years of operational experience). The following evaluation standards were used, and the evaluation was performed by feeling the texture with hand.

A: Number of the technical specialists who judged that the texture was superior was 9 or more.

B: Number of the technical specialists who judged that the texture was superior was 7 or 8.

C: Number of the technical specialists who judged that the texture was superior was 6 or less.

<Curling Characteristics>

For the evaluation of curling characteristics, a fiber bundle sample with a length of 500 mm and mass of 2.0 g was prepared with the artificial hair fiber. The fiber bundle sample was wound onto an aluminum tube of 20 mmφ while fixing both ends, and was placed in a steam oven at 100° C. and heated for 30 minutes. Subsequently, the aluminum tube (with the fiber being wound onto) was allowed to stand in a thermostatic chamber for 24 hours at 23° C. and relative humidity of 50%. Then, the fiber bundle was removed from the aluminum tube, and was hung down by fixing one end.

The length of the fiber bundle from the root to the tip was measured, and was divided by the total length before curling (50 cm). The value thus obtained was used for evaluation, and the smaller the value is, the more curl being provided to the fiber bundle. The evaluation standards are as follows.

A: the value is lower than 0.75

B: the value is 0.75 or higher and lower than 0.85

C: the value is 0.85 or higher

Comparative Example 1

In Comparative Example 1, curl retention was inferior since core/sheath mass ratio was too small.

Comparative Example 2

In Comparative Example 2, texture was inferior since core/sheath mass ratio was too large.

Comparative Examples 3 and 4

In Comparative Example 3, detachment resistance was inferior since viscosity ratio a/b was too large. In Comparative Example 4, detachment resistance was inferior since viscosity ratio a/b was too small.

In the Examples, the core/sheath mass ratio is in the range of 40/60 to 90/10, and the viscosity ratio a/b is in the range of 0.5 to 2.5. Accordingly, an artificial hair fiber having superior texture close to human hair and having superior curl retention can be obtained. Further, it became apparent that by using bromine-based flame retardant in combination, the bromine-based flame retardant would be dispersed in the interface between the polyester of the core and the polyamide of the sheath, resulting in improvement in detachment resistance and flame retardancy. In addition, it became apparent that by adding a compatibilizer to the polyester of the core and to the polyamide of the sheath, detachment resistance is improved, and thus iron curl can be provided at a higher temperature. Further, regarding the polyester of the core, it became apparent that when a resin prepared by mixing polyethylene terephthalate and polybutylene terephthalate or polytrimethylene terephthalate was used, the texture can be made even more close to human hair.

INDUSTRIAL APPLICABILITY

By using the artificial hair fiber having the core-sheath structure of the present invention, a hair product (head accessory) and the like having superior texture close to human hair and superior curl retention can be obtained. Accordingly, wig, hair piece, blade, extension hair, hair of dolls, and the like can be obtained.

The invention claimed is:

1. An artificial hair fiber having a core-sheath structure, comprising:

a core; and a sheath covering the core; wherein:

the core comprises a core resin composition including polyester;

the sheath comprises a sheath resin composition including polyamide;

the core and the sheath have a core/sheath mass ratio of 70/30 to 90/10;

when a melt viscosity of the polyester of the core is expressed as a, and a melt viscosity of the polyamide of the sheath is expressed as b, a viscosity ratio a/b is 0.5 to 2.5; and the polyester of the core resin composition comprises polyethylene terephthalate and polybutylene terephthalate, and a mass ratio of the polyethylene terephthalate and the polybutylene terephthalate is 40/60 to 90/10.

2. The artificial hair fiber of claim 1, wherein the core resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

3. The artificial hair fiber of claim 2, wherein the bromine-based flame retardant is added to the core resin composition by 3 to 30 parts by mass with respect to 100 parts by mass of the polyester.

4. The artificial hair fiber of claim 1, wherein the sheath resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

5. The artificial hair fiber of claim 4, wherein the bromine-based flame retardant is added to the sheath resin composition by 3 to 30 parts by mass with respect to 100 parts by mass of the polyamide.

6. The artificial hair fiber of claim 1, wherein the core resin composition further comprises a compatibilizer by 0.5 to 3 parts by mass with respect to 100 parts by mass of the polyester.

7. The artificial hair fiber of claim 1, wherein the sheath resin composition further comprises a compatibilizer by 0.5 to 3 parts by mass with respect to 100 parts by mass of the polyamide.

8. An artificial hair fiber having a core-sheath structure, comprising:

a core; and a sheath covering the core; wherein:

the core comprises a core resin composition including polyester;

the sheath comprises a sheath resin composition including polyamide;

the core and the sheath have a core/sheath mass ratio of 70/30 to 90/10;

when a melt viscosity of the polyester of the core is expressed as a, and a melt viscosity of the polyamide of the sheath is expressed as b, a viscosity ratio a/b is 0.5 to 2.5; and wherein the polyester of the core resin composition comprises polyethylene terephthalate and polytrimethylene terephthalate, and a mass ratio of the polyethylene terephthalate and the polytrimethylene terephthalate is 40/60 to 90/10.

9. The artificial hair fiber of claim 8, wherein the core resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

10. The artificial hair fiber of claim 9, wherein the bromine-based flame retardant is added to the core resin composition by 3 to 30 parts by mass with respect to 100 parts by mass of the polyester.

11. The artificial hair fiber of claim 8, wherein the sheath resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

12. The artificial hair fiber of claim 11, wherein the bromine-based flame retardant is added to the sheath resin composition by 3 to 30 parts by mass with respect to 100 parts by mass of the polyamide.

13. The artificial hair fiber of claim 8, wherein the core resin composition further comprises a compatibilizer by 0.5 to 3 parts by mass with respect to 100 parts by mass of the polyester.

14. The artificial hair fiber of claim 8, wherein the sheath resin composition further comprises a compatibilizer by 0.5 to 3 parts by mass with respect to 100 parts by mass of the polyamide.

15. An artificial hair fiber having a core-sheath structure, comprising:

a core; and a sheath covering the core; wherein:

the core comprises a core resin composition including polyester;

the sheath comprises a sheath resin composition including polyamide;

the core and the sheath have a core/sheath mass ratio of 70/30 to 90/10;

when a melt viscosity of the polyester of the core is expressed as a, and a melt viscosity of the polyamide of the sheath is expressed as b, a viscosity ratio a/b is 0.5 to 2.5; and the polyamide of the sheath resin composition comprises nylon 6,6 and nylon 6, and a mass ratio of the nylon 6,6 and the nylon 6 is 70/30 to 95/5.

16. The artificial hair fiber of claim 15, wherein the core resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

17. The artificial hair fiber of claim 16, wherein the bromine-based flame retardant is added to the core resin composition by 3 to 30 parts by mass with respect to 100 parts by mass of the polyester.

18. The artificial hair fiber of claim 15, wherein the sheath resin composition comprises at least one bromine-based flame retardant selected from the group consisting of brominated benzyl acrylate, brominated phenol, polydibromophenylene oxide, brominated polystyrene, ethylene bistetrabromophthalimide, bis(pentabromophenyl)ethane, brominated epoxy, brominated phenoxy, brominated polycarbonate and bromine containing triazine compound.

19. The artificial hair fiber of claim 18, wherein the bromine-based flame retardant is added to the sheath resin composition by 3 to 30 parts by mass with respect to 100 parts by mass of the polyamide.

20. The artificial hair fiber of claim 15, wherein the core resin composition further comprises a compatibilizer by 0.5 to 3 parts by mass with respect to 100 parts by mass of the polyester.

21. The artificial hair fiber of claim 15, wherein the sheath resin composition further comprises a compatibilizer by 0.5 to 3 parts by mass with respect to 100 parts by mass of the polyamide.

* * * * *